US005425931A

United States Patent [19]

Arai et al.

[11] Patent Number: 5,425,931

[45] Date of Patent: Jun. 20, 1995

[54] SMALL DIAMETER PITCH-BASED CARBON FIBER BUNDLE AND PRODUCTION METHOD THEREOF

[75] Inventors: Yutaka Arai, Kawasaki; Ken Kobayashi, Himeji; Kunio Miura, Himeji; Hiroyuki Tadokoro, Himeji; Yasuo Nagata, Himeji; Kazuhiko Mizuuchi, Himeji, all of Japan

[73] Assignees: Nippon Steel Corporation; Nippon Steel Chemical Co., Ltd., both of Tokyo, Japan

[21] Appl. No.: 117,530

[22] Filed: Sep. 7, 1993

[30] Foreign Application Priority Data

| | | | |
|---|---|---|---|
| Sep. 4, 1992 | [JP] | Japan | 4-260500 |
| Oct. 27, 1992 | [JP] | Japan | 4-310848 |
| Oct. 29, 1992 | [JP] | Japan | 4-312696 |

[51] Int. Cl.[6] ..... D01F 9/145

[52] U.S. Cl. ..... 423/447.2; 423/447.6

[58] Field of Search ..... 423/447.6, 449.2

[56] References Cited

U.S. PATENT DOCUMENTS

| | | | |
|---|---|---|---|
| 4,670,202 | 6/1987 | Uenoyama et al. | 423/447.6 |
| 4,816,195 | 3/1989 | Hettinger et al. | 423/447.6 |
| 4,895,212 | 1/1990 | Komine et al. | 423/447.6 |
| 5,004,511 | 4/1991 | Tamura et al. | 423/447.1 |
| 5,283,113 | 2/1994 | Nishimura et al. | 423/447.2 |

*Primary Examiner*—Wayne Langel
*Assistant Examiner*—Stuart L. Hendrickson
*Attorney, Agent, or Firm*—Wenderoth, Lind & Ponack

[57] ABSTRACT

A bundle of pitch-based carbon fibers which is composed of 1000 to 100,000 continuous fiber filaments having an average diameter of 4 to 8 μm, a filament tensile strength of at least 3.0 GPa, and a modulus of at least 600 GPa, and also a method for producing a fine diameter pitch-based carbon fiber wherein use is made of a spinning nozzle with a single nozzle plate which has at least 1000 capillary holes, has the capillaries arranged concentrically and circularly in 3 to 20 rows, has the capillaries positioned to be divided into at least two blocks, has a columnar projection protruding at least 20 mm from the surface of the nozzle plate at the center of the nozzle plate, and has capillaries of a diameter of 50 to 110 μm.

6 Claims, 5 Drawing Sheets

SMALL DIAMETER PITCH-BASED CARBON FIBER BUNDLE AND PRODUCTION METHOD THEREOF

BACKGROUND OF THE INVENTION

1. Field of the Invention

The present invention relates to a bundle of small diameter pitch-based carbon fibers and to a method for producing the same.

2. Description of the Related Art

In recent years, for carbon fiber having a modulus of more than 600 GPa, mainly pitch-based carbon fiber made from mesophase pitch as a raw material, with which it is easy to give a high modulus, has been produced and used. The higher the modulus of the fiber, the stiffer the fiber yarn, and therefore, the greater the occurrence of fluff or breakage of the fiber yarn at the time of handling of the fiber. Therefore, a finer diameter carbon fiber which is easier to handle has been desired.

On the other hand, when preparing composite products or their intermediates, it is desired to provide a carbon fiber with a large denier, that is, a large number of filaments, so as to reduce the number of bobbins of the carbon fiber used.

With a pitch-based carbon fiber, however, it was difficult to produce a multifilament continuous fiber composed of a fiber with an average fiber diameter of 8 μm or less and with at least 1000 filaments. To produce a fine-diameter fiber by a pitch-based carbon fiber, it is necessary to produce a fine-diameter pitch fiber. Pitch fiber, however, is extremely fragile and is difficult to spin, so it was extremely difficult to spin to give 1000 or more filaments. This is considered to have been because the formation of multiple holes in the nozzle plate causes the atmospheric temperature directly under the nozzle plate to become higher at the inner circumference due to the effect of the accompanying air flow caused at the time of spinning and, further, because the speed of the accompanying air flow becomes extremely great and that flow makes it impossible for fine-diameter fiber to be stably spun. By making the number of filaments lower, it becomes somewhat easier to spin a fine-diameter pitch fiber, but the resultant pitch fiber yarn is fragile and handling in the next process was difficult.

Japanese Unexamined Patent Publication (Kokai) No. 1-229820 describes a pitch-based carbon fiber with less than 1000 filaments. In this publication, a method is disclosed in which a pitch fiber yarn with less than 1000 filaments is obtained and several of these are doubled. With less than 1000 filaments and with a fine-diameter pitch fiber for giving the carbon fiber a fiber diameter of not more than 8 μm, however, the strength of the yarn is remarkably small, and therefore, it is difficult to give sufficient tension necessary for the doubling and only a carbon fiber with an insufficient fiber alignment could be obtained. Even if the greatest of care is taken and it were possible to produce a high grade carbon fiber by the doubling method, a complicated doubling process would have to be undertaken and this would make an increase in the price of the resultant carbon fiber inevitable.

To obtain the pitch fiber used as the raw material of a pitch-based carbon fiber by melt-spinning, the general practice is to provide a plurality of capillaries in the nozzle plate and extrude molten pitch from the spinning nozzle. In such an apparatus, an accompanying air flow is caused by the spun out yarn at the spinning side of the nozzle plate. Usually, the nozzle plate is disposed in an annular fashion with respect to the circular nozzle from the heat transmission surface, but in this case, the atmosphere directly beneath the nozzle plate becomes higher in temperature at the inside and lower in temperature at the outer circumference due to the effect of the accompanying air flow, which results in a large difference in the atmosphere. Therefore, it was not possible to stably spin or it was difficult to obtain a high grade fiber. Therefore, proposals have been made for blowing cooling gas at the bottom center of the spinning nozzle, attaching a mesh pipe, etc., to lower the temperature of the atmosphere at the inner circumference of the nozzle.

In particular, as a method suitable for spinning a pitch-based carbon fiber, Japanese Unexamined Patent Publication (Kokai) No. 62-231009 proposes a method of adjusting the atmospheric temperature by placing a hollow tubular body at the inside of an annular array of spinning capillaries. In a spinning nozzle having 500 capillary holes or more in a single spinning nozzle, however, it was not possible to stably spin just by adjusting the atmospheric temperature. The problem was that effect of the accompanying air flow became greater due to the formation of multiple holes and not only the atmospheric temperature directly beneath the nozzle plate, but also the speed of the air flow became extremely large. The air flow prevented stable spinning.

SUMMARY OF THE INVENTION

The object of the present invention is to provide a high grade carbon fiber bundle which has a high modulus and yet is superior in handling characteristics of the fiber and is superior in productivity when used for shaping a composite.

Another object of the present invention is to provide a spinning nozzle for pitch fiber which makes it possible to stably spin pitch fiber for fine-diameter carbon fiber with a fiber diameter of 4 to 8 μm using a spinning nozzle having at least 1000 capillary holes, and to provide a method of production of a fine-diameter multifilament carbon fiber.

In accordance with a first aspect of the present invention, there is provided a bundle of pitch-based carbon fibers which is composed of 1000 to 100,000 continuous fiber filaments having an average diameter of 4 to 8 μm, a filament tensile strength of at least 3.0 GPa, and a modulus of at least 600 GPa.

Further, the flexural strength B of the fiber bundle preferably satisfies the following equation:

$$B \geqq \frac{1}{2.875 \times 10^{-4}\, TM - 0.17} \qquad \text{(I)}$$

where,

B=flexural strength (MPa)

TM=tensile modulus (GPa)

In accordance with another aspect of the present invention, there is provided:

(1) a method for producing a bundle of small-diameter pitch-based carbon fibers wherein, when melting a spinning pitch and using a spinning nozzle to obtain a pitch fiber and applying an infusibilization and carbonization to produce a carbon fiber, the spinning is performed using a spinning nozzle with a single nozzle plate which:

(a) has at least 1000 capillary holes, (b) has the capillaries arranged concentrically and circularly in 3 to 20 rows, (c) has the capillaries positioned divided into at least two blocks, (d) has a columnar projection protruding at least 20 mm from the surface of the nozzle plate at the center of the nozzle plate, and (e) has capillaries of a diameter of 50 to 110 μm so as to produce a multifilament pitch-based carbon fiber composed of a continuous fiber with an average fiber diameter of 4 to 8 μm and composed of 1000 to 100,000 filaments and there is further provided:

(2) a method for producing a bundle of small-diameter pitch-based carbon fibers where a plurality of the above-mentioned spinning nozzles are provided and the pitch fibers extruded from the plurality of nozzles are drawn by a single roll and spun so as to produce a multifilament pitch-based carbon fiber composed of a continuous fiber with an average fiber diameter of 4 to 8 μm and composed of 1000 to 100,000 filaments.

BRIEF DESCRIPTION OF THE DRAWINGS

The present invention will be described in further detail by the following explanation made with reference to the attached drawings, in which.

DESCRIPTION OF THE PREFERRED EMBODIMENTS

The present invention will be explained in further detail below.

The carbon fiber bundle of the present invention has an average fiber diameter of 4 to 8 μm and is comprised of 1000 to 100,000 continuous fiber filaments.

Further, it is a pitch-based carbon fiber bundle having superior physical properties such as a tensile strength of the filaments comprising the fiber bundle of at least 3.0 GPa and a modulus of at least 600 GPa and superior in handling characteristics, with a flexural strength of the fiber bundle satisfying the above-mentioned equation. The fiber bundle is not a combination of a plurality of fiber bundles.

In the present invention, the average fiber diameter, the tensile strength, the modulus, and the flexural strength mean the values found in the following way.

(Average fiber diameter)

The average fiber diameter D of the carbon fiber is obtained from the following equation:

$$D = \sqrt{\frac{4W}{N\rho\pi}}$$

where,

W=weight of fiber bundle per unit length

N=number of filaments p=density of fiber (Tensile strength and modulus of filament)

The tensile strength was obtained in accordance with the resin impregnated strand test method defined in JIS (i.e., Japanese Industrial Standards) R7601.

For the tensile modulus, the tensile modulus in the range of 10 to 30% of a breaking load was found by the direct reading method.

(Flexural strength)

Figure 14:
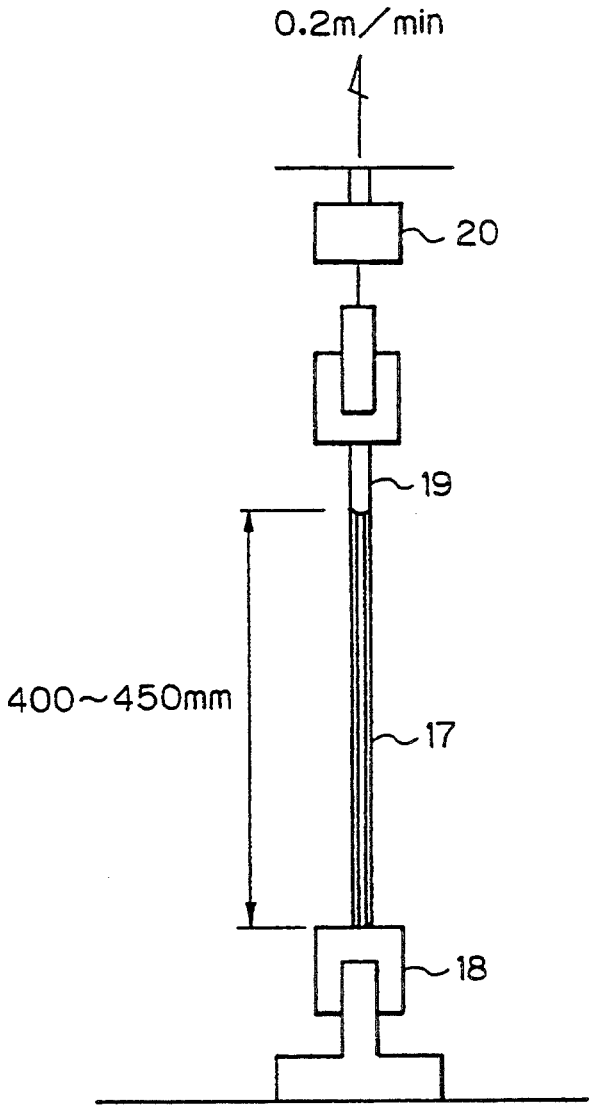
FIG. 14 is a schematic view of measurement of the flexural strength.

As shown in FIG. 14, a carbon fiber bundle 17 of a length of 1 meter was taken out. The two ends of the carbon fiber bundle 17 were aligned and a tab 18 was attached by an adhesive to form a loop shaped fiber bundle. A wire 19 of a diameter of 1 mm was hooked with the loop portion and the wire or the tab was pulled at a rate of 0.2 m/min. The load when the loop was broken at the wire portion, measured by a spring balance 20, was divided by the cross-sectional area of the carbon fiber bundle to obtain the flexural strength.

With an average fiber diameter of over 8 μm, it is not possible to provide both the contradictory properties of a high modulus and superior handling characteristics. With a diameter of less than 4 μm, it is difficult in practice to produce a continuous fiber. To improve the productivity when processing a composite product or its intermediate, it is necessary that the number of filaments of the fiber bundle be at least 1000, preferably at least 2000. With less than 1000 filaments, the denier of the carbon fiber bundle is small and the productivity is impaired. Further, it is difficult to produce a fiber bundle with over 100,000 filaments.

The tensile strength is at least 3.0 GPa, preferably at least 3.5 GPa, more preferably at least 4.0 GPa. If less than 3.0 GPa, the elongation of the fiber is extremely small and the handling of the fiber bundle becomes difficult. The flexural strength changes tremendously depending on the modulus, but for example the handling characteristics of the fiber bundle are remarkably impaired if less than 400 MPa with a modulus of 600 GPa, if less than 32 MPa with a modulus of 700 GPa, and if less than 17 MPa with a modulus of 800 GPa.

The fiber bundle of the present invention is characterized by being an undoubled yarn. In the production of a pitch-based carbon fiber, after the pitch fiber bundle is once obtained, even if doubled in the pitch fiber state or after an infusibilization or carbonization to obtain a large denier fiber bundle, the bundle splits into the pre-doubling fiber bundles, and therefore, the handling characteristics at the time of use of the fiber bundle become remarkably deteriorated. Therefore, the precursor of the fiber bundle of the present invention, that is, the pitch fiber, has to be produced with 1000 to 100,000 filaments at the spinning stage without doubling.

An example of the method of production for obtaining the graphitized fiber of the present invention and an example of a melt-spinning apparatus of the present invention will be explained below.

Figure 1:
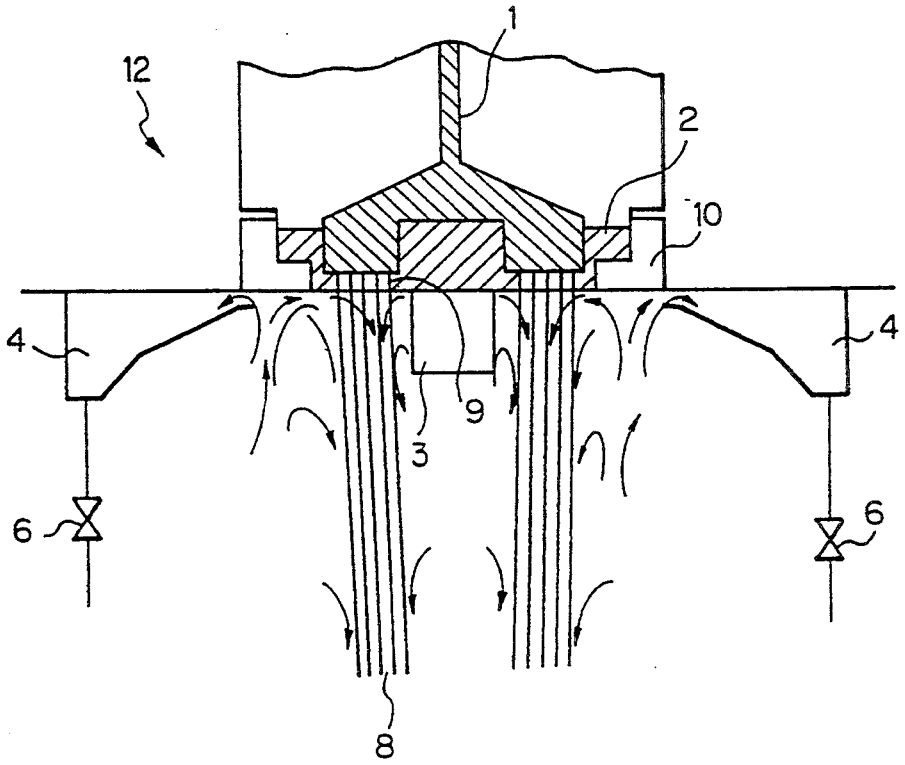
FIG. 1 is a cross-sectional view of a melt-spinning nozzle.
Figure 2:
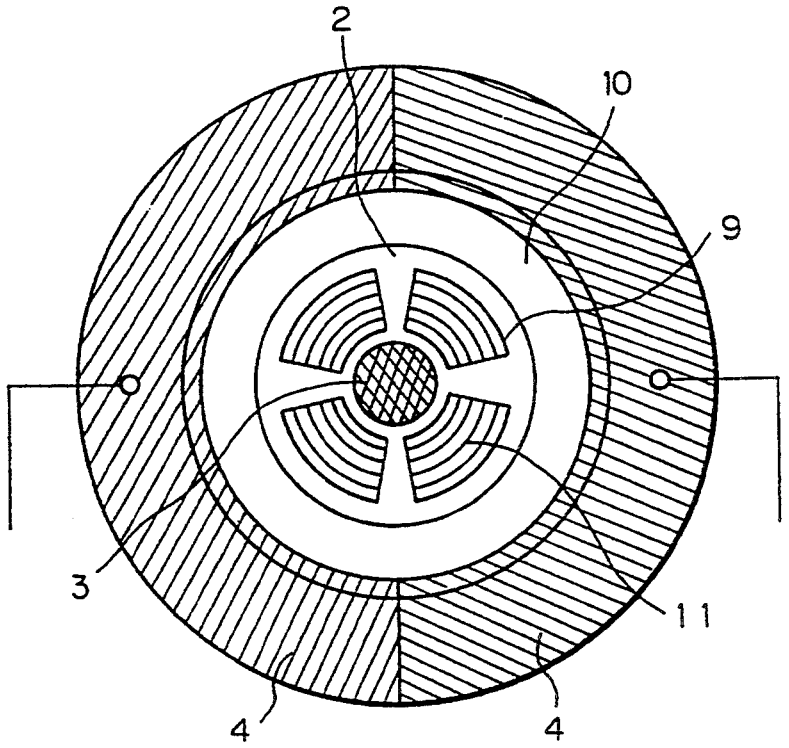
FIG. 2 is a bottom view of a melt-spinning nozzle.
Figure 3:
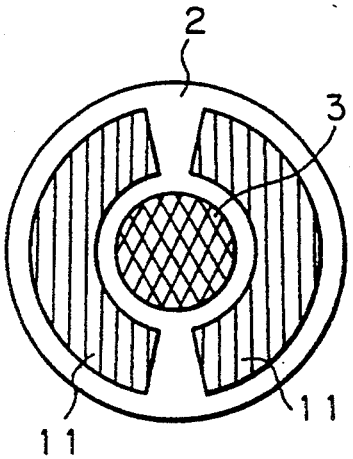
FIG. 3 is a view of the disposition of the capillaries of the nozzle.

FIG. 1 is a cross-sectional view of a melt-spinning nozzle. The melt-spinning nozzle 12 obtains a pitch fiber 8 by spinning a molten pitch 1 and is provided with a nozzle plate 2. The nozzle plate 2 has a plurality of capillaries 9 disposed in it. The capillaries 9 are disposed concentrically and circularly in 3 to 20 rows. The radius of the outermost circumference of the positions of the concentrically and circularly disposed capillaries is preferably 50 to 250 mm, more preferably 100 to 200 mm. With less than three rows of disposition of capillaries, it is difficult to dispose 1000 capillaries or more in a single nozzle plate or the nozzle plate becomes extremely large. Further, with over 20 rows, the atmospheric temperature at the center of the rows becomes higher compared with the atmospheric temperature at the outer circumference rows or the inner circumference rows and stable spinning becomes difficult. Note that reference numeral 10 shows a nozzle plate holder.

As shown in FIG. 2 and FIG. 3 to FIG. 8, it is necessary to divide the locations of disposition of the capillaries into at least two blocks by capillary disposition blocks 11. The interval between one capillary and another is preferably 1 to 6 mm, more preferably 2 to 3 mm.

The interval between one block and another preferably is, in the case of division in an arcuate form (FIG. 3 to FIG. 6), one of a 10° to 30° angle or is at least 10 mm at the narrowest portion.

The diameter of the capillaries is 50 μm to 110 μm, preferably 70 μm to 100 μm. With a diameter of the capillaries of over 110 μm, spinning of a fine-diameter pitch fiber becomes unstable and with one less than 50 μm, the capillaries become very difficult to produce and the nozzle maintenance becomes complicated.

If the locations where the capillaries are disposed are not divided, but are continuously concentric and circular, insufficient atmospheric gas is introduced to the center of the nozzle, the atmosphere at the center of the nozzle becomes high in temperature, and continuation of stable spinning becomes difficult.

Further, in the present invention, it is crucial that a columnar projection 3 of a height of at least 20 mm, preferably 30 to 150 mm, be provided at the bottom of the nozzle plate. The columnar projection 3 performs the role of controlling the flow of air passing through the gaps between the blocks where the capillaries are disposed. If there were no projection 3 or if the height were less than 20 mm, the flows of air through the gaps between blocks would collide at the center of the nozzle, creating an extremely turbulent air flow at the center of the nozzle and therefore making stable spinning near the center of the nozzle (near the capillaries disposed near the innermost circumference of the nozzle) extremely difficult. By the columnar projection and dividing the capillaries into blocks, it becomes possible to create the two effects of cooling the inner circumference of the nozzle and stabilizing the spinning by the accompanying air flow. The columnar projection 3, as shown in FIGS. 9 to 12, is not limited to a geometrically precise column. Even if one end of the column is reduced in diameter or the edges are rounded, no significant difference is seen in the effects. It is sufficient if the height H shown in FIGS. 9 to 12 is at least 20 mm, preferably 30 to 150 mm.

If the above requirements are satisfied, then it becomes possible for the first time to perform stable spinning even with a nozzle having a number of capillaries considered totally impossible in a conventional spinning apparatus, that is, 1000 or more, preferably 1500 to 10,000, capillaries per nozzle, more preferably 1500 to 5000 capillaries, even more preferably 2000 to 4000 capillaries.

When melt-spinning pitch fiber, however, the vapor produced from the pitch at the time of the melt-spinning, or the decomposed products, cause remarkable fouling of the nozzle plate surface. Therefore, the period over which stable spinning was continuously performed had to be limited due to the fouling of the nozzle plate. Therefore, it was discovered that by bringing the accompanying air flow caused during the spinning near to the nozzle plate, the atmosphere directly under the nozzle plate is replaced well and the fouling of the nozzle is remarkably reduced.

More specifically, by providing a peripheral slit in the bottom of the nozzle plate at the outer circumference of the area where the capillaries are disposed, the accompanying air flow caused by the spinning is made to flow directly under the nozzle plate. At this time, the slit should be at least 20 mm, preferably 50 to 200 mm, from the outermost circumference of the area of disposition of the capillaries and the width of the slit is preferably 5 to 30 mm.

If the radius of the outermost circumference of the positions of the concentrically circularly disposed capillaries exceeds 100 mm, it becomes difficult to perform even suction over the slit as a whole at one suction position, so stable spinning becomes possible by dividing this into two or more positions, preferably four to eight positions, if necessary, and controlling these to give a uniform amount of suction. The flow of air at that time, as shown in FIG. 1, is directly under the nozzle plate as the starting position of the accompanying air flow is drawn to the nozzle plate 2 side overall due to the suction of the suction slit 4. Further, the air flow passing through the gaps between blocks where the capillaries are positioned is given a downward orientation by the columnar projection 3 and flows stably without disturbance, so stable spinning becomes possible. In FIG. 1, reference numeral 6 shows a suction adjustment damper.

The material of the spinning pitch used in the present invention includes various types of pitch, such as coal tar, coal tar pitch, and other coal-based pitches, coal liquefied pitch, ethylene tar pitch, decant oil pitch obtained from the residual oil of the fluidized catalytic cracking and other oil-based pitches, and synthetic pitches prepared from naphthalene, etc. using a catalyst, etc.

The mesophase pitch used for the present invention is obtained by treating the above-mentioned pitch by a known method to cause the occurrence of the mesophase. Mesophase pitch preferably is one with a high orientation of the pitch fiber at the time of spinning, therefore the content of the mesophase is preferably at least 40%, more preferably at least 70%, even more preferably at least 90%. Also, the mesophase pitch may be one with a softening point of 200° to 400° C., more preferably 250° to 350° C. The resultant pitch has to be cleared of the foreign matter in it before spinning by a filter with an absolute filtration acccuracy of less than 3 μm or a filtration method giving a filtration precision equal to or better than that of this filter. If solid foreign matter of more than 3 μm size is present in the pitch, the fiber will frequently break.

Figure 13:
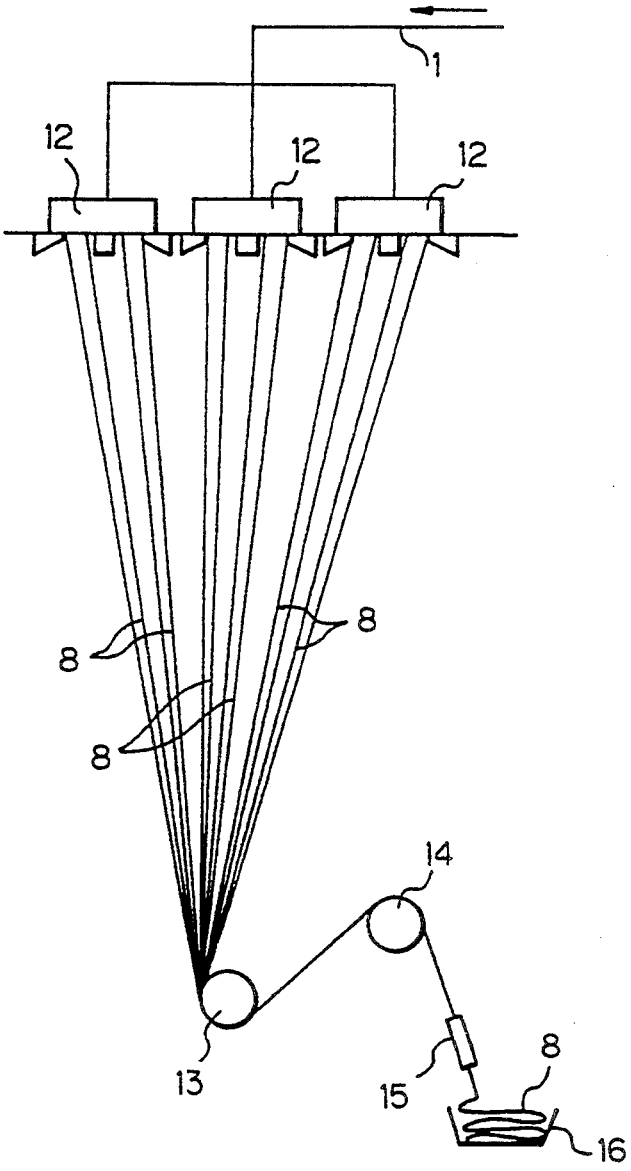
FIG. 13 is a schematic view of a melt-spinning apparatus.

FIG. 13 is a schematic view showing an example of a spinning apparatus used in the present invention.

Regarding the conditions for spinning the above-mentioned mesophase pitch by the previously mentioned spinning nozzle, for example, the pitch is extruded at a temperature giving a viscosity of 200 to 900 poises and at a pressure of about 10 to 100 kg/cm$^2$ and is drawn at a take-up speed of 100 to 1000 m/min, preferably 300 to 600 m/min, to obtain a pitch fiber with a predetermined fiber diameter. At this time, it is possible to use a single spinning nozzle having 1000 capillaries or more to obtain the pitch fiber, or to use two or more spinning nozzles. For example, as shown in FIG. 13, in a spinning apparatus with a plurality of spinning nozzles of the present invention, the pitch fibers extruded from the spinning nozzles are drawn by a single roll to obtain a multifilament pitch fiber. The number of the spinning nozzles arranged there at this time is preferably not more than 10. If more than this number, the adjustments among the nozzles becomes complicated and, further, the interval between spinning nozzles becomes greater and it becomes difficult to draw the fiber with a single roll, so production of a multifilament carbon fiber with a good fiber alignment becomes difficult.

Note that in FIG. 13, reference numeral 13 is a draw roll transport roll, 14 is a pitch fiber transport roll, 15 is a pitch fiber bundle suction nozzle, and 16 is a pitch fiber storage case.

Using the above-mentioned spinning nozzle, it is possible to obtain a pitch fiber for a fine-diameter carbon fiber with 1000 filaments or more, but to cause a uniform reaction of the fiber bundle as a whole in the non-fusing process, the upper limit of the number of filaments is 100,000, preferably 50,000. Regarding the fiber diameter of the pitch fiber, since the fiber diameter shrinks due to the infusibilization, carbonization, and graphitization, the fiber diameter of the pitch fiber should be decided on considering this. Usually, it is possible to obtain a fine-diameter carbon fiber with a fiber diameter of 4 to 8 μm by spinning to a diameter of the pitch fiber of 5 to 11 μm.

Next, the resultant pitch fiber is subjected to infusibilization, carbonization, and graphitization by conventionally known methods, whereupon a pitch-based carbon fiber bundle composed of fine-diameter carbon fiber of a fiber diameter of 4 to 8 μm and 1000 to 100,000 filaments is obtained.

EXAMPLES

The present invention will now be explained in further detail in accordance with the following Examples.

Example 1

As a raw material, coal tar pitch having a softening point of 80° C., from which a quinoline insoluble matter was removed, was subjected to direct hydrogenation using a catalyst. The hydrogenated pitch was heat treated at 480° C. under ordinary pressure, then was cleared of low boiling point matter to obtain the mesophase pitch. The pitch had a softening point of 300° C. and a mesophase content of 95%. The pitch was filtered using a stainless steel fiber filter having a filtration accuracy of 3 μm and at a temperature of 340° C. and was cleared of the foreign matter contained therein to obtain the refined pitch.

Figure 5:
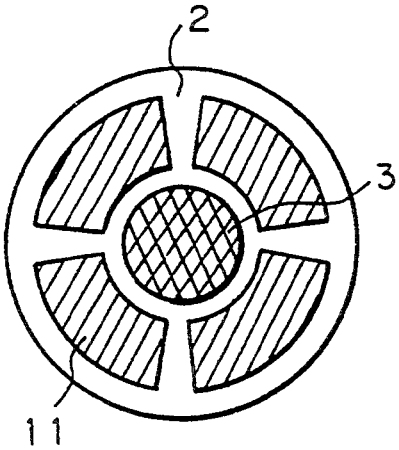
FIG. 5 is a view of still another disposition of the capillaries of the nozzle.
Figure 4:
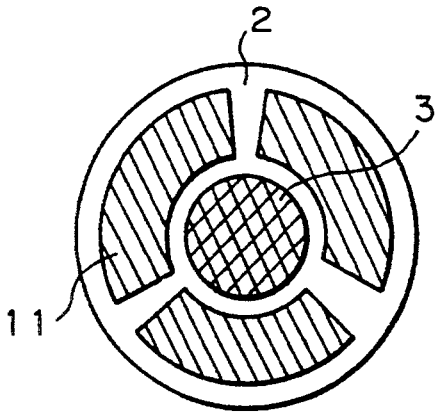
FIG. 4 is a view of another disposition of the capillaries of the nozzle.
Figure 6:
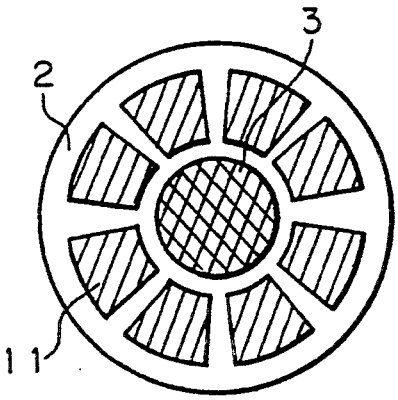
FIG. 6 is a view of still another disposition of the capillaries of the nozzle.
Figure 7:
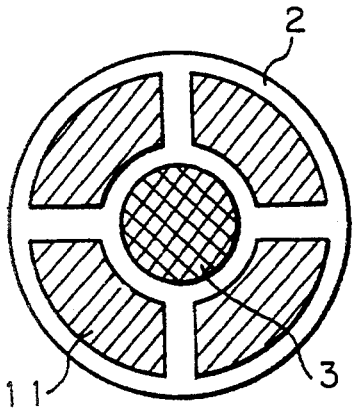
FIG. 7 is a view of still another disposition of the capillaries of the nozzle.

This refined pitch was used as a raw material for the spinning and was spun using a nozzle pack composed of a 220 mm diameter nozzle plate with capillaries having a diameter of 100 μm, a capillary length of 150 μm, and 2000 capillary holes. The disposition of the capillaries was as shown in FIG. 5. The capillaries disposed at the outermost circumference were positioned at a radius of 100 mm and those at the innermost circumference at a radius of 75 mm. There were four blocks with 11 rows of concentrically and circularly disposed capillaries at intervals of an angle of 23°. At the center of the nozzle, a columnar projection with a height of 50 mm, a diameter of 120 mm, and the cross-sectional shape of FIG. 9 was provided. Further, a slit of a diameter of 300 mm and a width of 300 mm was made in the outer circumference of the nozzle plate and suction was performed separately from four directions.

The surface temperature of the nozzle plate was made 316° C., the spinning viscosity was made 600 poises, and the pitch flow per capillary was made 0.043 g/min. The roll was rotated for drawing to give a spinning speed of 400 m/min. The resultant pitch fiber was taken up by a suction nozzle and stored in a can. At this time, there was no fiber breakage over a long period of 6 hours and a pitch fiber having an average fiber diameter of 9.8 μm and 2000 filaments was obtained.

Next, with the pitch fiber stored in the can, while blowing oxidizing gas composed of air plus 5% by volume of nitrogen dioxide gas from the bottom of the can, the temperature was raised from 150° C. to 300° C. at a rate of 1° C./min. The fiber was held in that state at 300° C. for 30 minutes to obtain an infusible fiber. With this infusible fiber stored in the can, the infusible fiber was raised in temperature by 10° C./min in a nitrogen gas atmosphere until 390° C. and was held at that temperature for 30 minutes for the carbonization.

Next, the carbonized fiber was sintered in the linear form in a furnace with an inner temperature of 1100° C. and a nitrogen gas atmosphere while feeding out the fiber yarn from the can and was taken up on a bobbin. The carbonized fiber yarn was unwound from the bobbin and graphitized at a temperature of 2400° C. to obtain a graphitized fiber.

The graphitized fiber thus obtained was beautiful and had an average fiber diameter of 7.0 μm, a tensile strength of 4.2 GPa, a modulus of 620 GPa, 2000 filaments, a flexural strength of 680 MPa, and a good fiber alignment.

Example 2

The carbon fiber obtained in Example 1 was graphitized at a temperature of 2600° C. to obtain a graphitized fiber.

The graphitized fiber had an average fiber diameter of 6.9 μm, a tensile strength of 4.1 GPa, a tensile modulus of 800 GPa, 2000 filaments, and a flexural strength of 50 MPa.

Example 3

Spinning was performed using a spinning nozzle having exactly the same construction as the nozzle used in Example 1, except that the capillary diameter was made 80 μm and the capillary length 120 μm, and at a surface temperature of the nozzle plate of 323° C., a spinning viscosity of 400 poises, and a pitch flow per capillary of 0.022 g/min so that the spinning speed became 400 m/min. At this time,there was no fiber breakge over a long period of 2 hours and a pitch fiber with an average fiber diamter of 7.0 μm and 2000 filaments was obtained.

The pitch fiber was subjected to infusibilization and carbonization under the same conditions as in Example 1. Graphitization was performed at a temperature of 2500° C.

The resultant graphitized fiber was beautiful and had an average fiber diameter of 4.9 μm, a tensile strength of 4.7 GPa, a modulus of 620 GPa, 2000 filaments, a flexural strength of 1200 MPa, and a good fiber alignment.

Example 4

Three spinning nozzle used in Example 1 were arranged in parallel in a straight line. The pitch fibers extruded from the three nozzles were simultaneously drawn and spun by a single roll positioned under the spinning nozzle positioned at the center of the three. The spinning conditions at this time were a surface temperature of the nozzle plate of 316° C., a spinning viscosity of 600 poises, and a pitch flow per capillary of 0.035 g/min. The roll was rotated to perform drawing so that the spinning speed became 400 m/min. The resultant pitch fiber was taken up by a suction nozzle and stored in a can.

At this time, there was no fiber breakage over a long period of 2 hours and a pitch fiber with an average fiber diameter of 8.8 μm and 6000 filaments was obtained.

The pitch fiber was subjected to infusibilization and carbonization under the same conditions as in Example 1. Graphitization was performed at a temperature of 2500° C. The resultant graphitized fiber had an average fiber diameter of 6.3 μm, a tensile strength of 4.2 GPa, a modulus of 710 GPa, 6000 filaments, and a flexural strength of 250 MPa.

This fiber bundle was used to prepare a cylindrical roll of a carbon fiber composite by an ordinary filament winding method. It was possible to produce a composite product stably with a high modulus, without fluff or fiber breakage.

Comparative Example 1

Spinning was performed under the same conditions as in Example 1, except that the diameter of the capillaries in the nozzle used in Example 1 was made 130 μm and the flow of pitch per capillary was made 0.069 g/min, to obtain a pitch fiber having an average fiber diameter of 12.9 μm and 2000 filaments.

Infusibilization carbonization, and graphitization were performed on the pitch fiber under the same conditions as in Example 1. The resultant graphitized fiber had an average fiber diameter of 9.8 μm, a tensile strength of 3.9 GPa, a modulus of 620 GPa, 2000 filaments, and a flexural strength of 240 MPa.

Comparative Example 2

The carbon fiber obtained in Comparative Example 1 was graphitized at a temperature of 2500° C. It was subjected to infusibilization, carbonization, and graphitization in the same way as in Example 1 to obtain a graphitized fiber.

The graphitized fiber had an average fiber diameter of 9.7 μm, a tensile strength of 3.8 GPa, a modulus of 710 GPa, 2000 filaments, and a flexural strength of 25 MPa.

The fiber bundle was used to prepare a composite product the same as in Example 4, whereupon there was considerable fluff and there was fiber breakage in the fiber bundle during the production.

Comparative Example 3

The carbon fiber obtained in Comparative Example 1 was graphitized at a temperature of 2600° C. It was subjected to infusibilization, carbonization, and graphitization in the same way as in Example 1 to obtain a graphitized fiber.

The graphitized fiber had an average fiber diameter of 9.7 μm, a tensile strength of 3.6 GPa, a modulus of 805 GPa, 2000 filaments, and a flexural strength of 5 MPa.

Comparative Example 4

A commercially available pitch-based carbon fiber made by a company A had 2000 filaments, an average fiber diameter of 9.7 μm, a tensile strength of 2.2 GPa, and a modulus of 700 GPa. The flexural strength was not more than 1 MPa—so small a value as to be not measurable.

Comparative Example 5

Spinning was performed under exactly the same conditions as in Example 1, except that the spinning was performed without the columnar projection of Example 1, whereupon there was frequent fiber breakage from the capillaries disposed at the inner circumference of the nozzle and continuous spinning was not possible.

Comparative Example 6

Spinning was performed under exactly the same conditions as in Example 1, except that the diameter of the capillaries in the nozzle used in Example 1 was made 130 μm, whereupon fiber breakage occurred about once in 5 minutes and stable continuous spinning was not possible.

Comparative Example 7

Spinning was performed under exactly the same conditions as in Example 1, except that use was made of a nozzle of the same construction of the nozzle used in Example 1, but with the capillaries concentrically and circularly disposed (not divided by blocks), whereupon the fiber frequently broke and continuous spinning was not possible.

Example 5

The same procedure was followed as in Example 4 to obtain a graphitized fiber, except that the graphitization temperature was made 2400° C.

The resultant graphitized fiber was a beautiful one with an average fiber diameter of 6.3 μm, a tensile strength of 4.3 GPa, a modulus of 605 GPa, 6000 filaments, and a good fiber alignment.

Example 6

As a raw material, coal tar pitch having a softening point of 80° C., from which a quinoline insoluble matter was removed, was subjected to direct hydrogenation using a catalyst. The hydrogenated pitch was heat treated at 480° C. under an ordinary pressure, then was cleared of low boiling point matter to obtain the mesophase pitch. The pitch had a softening point of 304° C. and a mesophase content of 95%.

The pitch was used as a material and spinning was performed using a nozzle pack comprised of a 220 mm diameter nozzle plate with 2000 capillaries of a diameter of 0.12 mm. The disposition of the capillaries was as shown in FIG. 5. The capillaries disposed at the outermost circumference were positioned at a radius of 100 mm and those at the innermost circumference at a radius of 75 mm. There were four blocks with 11 rows of concentrically and circularly disposed capillaries at intervals of an angle of 23°.

Figure 9:
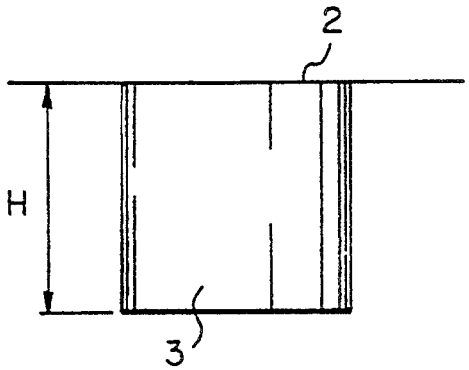
FIG. 9 is a side view of the columnar projection.
Figure 8:
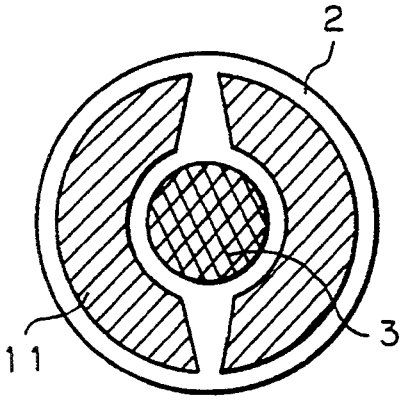
FIG. 8 is a view of still another disposition of the capillaries of the nozzle.
Figure 10:
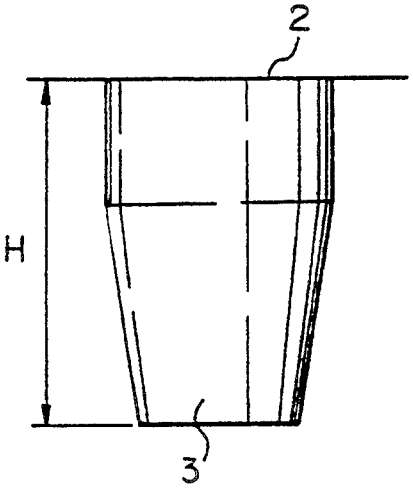
FIG. 10 is a side view of another columnar projection.
Figure 11:
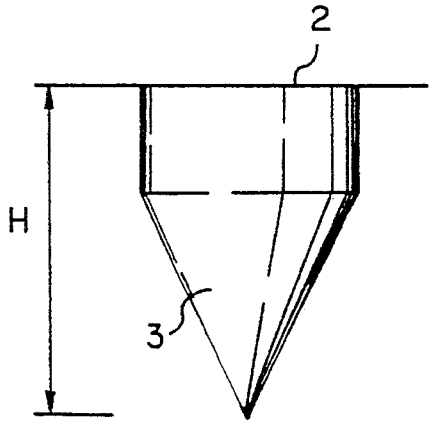
FIG. 11 is a side view of still another columnar projection.
Figure 12:
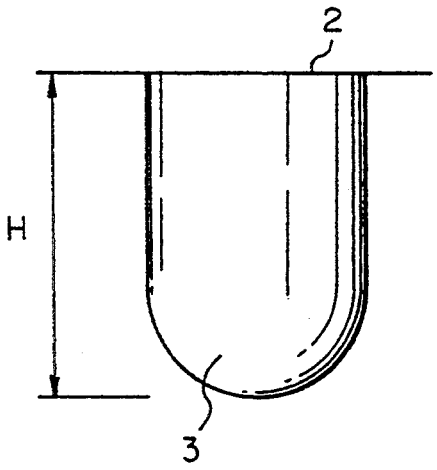
FIG. 12 is a side view of still another columnar projection.

At the center of the nozzle, the columnar projection of FIG. 9 of a height of 50 mm and a diameter of 120 mm was provided. Further, a slit of a diameter of 300 mm and a width of 15 mm was provided at the outer circumference of the nozzle plate and suction was performed separately from four directions.

Spinning was performed with a surface temperature of the nozzle plate of 320° C., a spinning speed of 350 m/min, and a pitch flow per capillary of 0.055 g/min. As a result, stable spinning was possible without fiber breakage over a long period (about 6 hours).

Comparative Example 8

Spinning was performed without the columnar projection of Example 6, whereupon yarn breakage frequently occurred from the capillaries disposed at the inner circumference of the nozzle and continuous spinning was impossible.

Comparative Example 9

The suction from the suction slit portion in Example 6 was stopped, whereupon it was possible to spin stably without yarn breakage up until about 30 minutes, but yarn breakage was frequent.

Comparative Example 10

Use was made of a nozzle of a similar structure as the nozzle plate used in Example 6, but with the capillaries disposed on a concentric circle (not divided by blocks), whereupon yarn breakage was frequent and spinning was not possible.

As explained above, the pitch-based carbon fiber bundle composed of the fine-diameter fiber of the present invention is a carbon fiber bundle which has the contradictory advantages of a high modulus of elasticity, which is a feature of the conventional pitch-based carbon fiber, and superior handling characteristics of the fiber. Further, it has a denier or number of filaments suitable for production of a composite product or its intermediate, and therefore, use with superior productivity becomes possible.

Further, according to the present invention, it is possible to perform stable spinning without fiber breakage for a long period and it is possible to efficiently produce fine-diameter multifilament pitch-based carbon fiber.

We claim:

1. A single bundle of pitch-based carbon fibers comprising 1000 to 100,000 continuous fiber filaments each having an average diameter of 4 to 8 μm, a tensile strength of at least 3.0 GPa, and a modulus of at least 600 GPa.

2. A carbon fiber bundle as claimed in claim 1, wherein the flexural strength B of the fiber bundle satisfies the following equation:

$$B \geqq \frac{1}{2.875 \times 10^{-4}\, TM - 0.17} \qquad \text{(I)}$$

where,

B=flexural strength (MPa)

TM=tensile modulus (GPa).

3. A method for producing a bundle of small-diameter pitch-based carbon fibers, which comprises melting a spinning pitch, spinning the melted pitch to obtain pitch fibers and applying infusibilization and carbonization to the pitch fibers to produce carbon fibers, wherein the spinning is performed using a spinning nozzle with a single nozzle plate which (a) has at least 1000 capillary holes, (b) has the capillaries arranged concentrically and circularly in 3 to 20 circles, (c) has the capillaries in at least two regions, (d) has a columnar projection protruding at least 20 mm from the surface of the nozzle plate at the center of the nozzle plate, and (e) has capillaries of a diameter of 50 to 110 μm so as to produce multifilament pitch-based carbon fibers composed of a continuous fiber with an average fiber diameter of 4 to 8 μm and composed of 1000 to 100,000 filaments.

4. A method as claimed in claim 3, wherein a suction slit is provided at the outer circumference of the spinning nozzle.

5. A method as claimed in claim 4, wherein the suction slit is divided into two or more slits.

6. A method for producing of a bundle of small-diameter pitch-based carbon fibers, which comprises providing a plurality of spinning nozzles, extruding pitch filaments from the plurality of nozzles, drawing the extruded pitch filaments by a single roll and spinning the drawn pitch filaments so as to produce multifilament pitch-based carbon fibers composed of a continuous fiber with an average fiber diameter of 4 to 8 μm and composed of 1000 to 100,000 filaments, wherein each spinning nozzle has a single nozzle plate which (a) has at least 1000 capillary holes, (b) has the capillaries arranged concentrically and circularly in 3 to 20 circles, (c) has the capillaries in at least two regions, (d) has a columnar projection protruding at least 20 mm from the surface of the nozzle plate at the center of the nozzle plate, and (e) has capillaries of a diameter of 50 to 110 μm.

* * * * *